US011248381B1

(12) United States Patent
van Hoytema

(10) Patent No.: US 11,248,381 B1
(45) **Date of Patent: *Feb. 15, 2022**

(54) MODULAR RIGGING SYSTEM USING HEXAGONAL SUPPORT PIECES

(71) Applicant: Furious People, Beverly Hills, CA (US)

(72) Inventor: Hoyte van Hoytema, Los Angeles, CA (US)

(73) Assignee: FURIOUS PEOPLE, Beverly Hills, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/538,374

(22) Filed: Aug. 12, 2019

Related U.S. Application Data

(63) Continuation of application No. 15/842,462, filed on Dec. 14, 2017, now Pat. No. 10,465,395.

(60) Provisional application No. 62/434,801, filed on Dec. 15, 2016.

(51) Int. Cl.

| | |
|---|---|
| ***E04G 1/12*** | (2006.01) |
| ***E04G 1/18*** | (2006.01) |
| ***E04G 7/26*** | (2006.01) |
| *E04G 5/16* | (2006.01) |

(52) U.S. Cl.
CPC ..... *E04G 1/12* (2013.01); *E04G 1/18* (2013.01); *E04G 7/26* (2013.01); *E04G 5/16* (2013.01)

(58) Field of Classification Search
CPC .... E04G 1/12; E04G 1/18; E04G 7/26; E04G 5/16
See application file for complete search history.

(56) References Cited

U.S. PATENT DOCUMENTS

| | | | | |
|---|---|---|---|---|
| 2,888,546 | A * | 5/1959 | Kinney | H05B 3/80 392/441 |
| 3,899,588 | A * | 8/1975 | Skov | C07C 51/412 514/557 |
| 8,020,259 | B2 * | 9/2011 | Ho | F16L 3/222 24/129 R |
| D796,066 | S | 8/2017 | Shell | |
| 2003/0129919 | A1 * | 7/2003 | Glickman | A63H 33/101 446/126 |
| 2012/0074624 | A1 | 3/2012 | Wood | |
| 2016/0033075 | A1 | 2/2016 | Smith et al. | |
| 2017/0232357 | A1 * | 8/2017 | Rosen | A63H 33/04 446/92 |
| 2018/0238487 | A1 | 8/2018 | Smith et al. | |

* cited by examiner

*Primary Examiner* — Alvin C Chin-Shue
(74) *Attorney, Agent, or Firm* — Amster, Rothstein & Ebenstein LLP

(57) ABSTRACT

A rigging system comprising a plurality of members including: a first hexagonal support piece comprising six side members, a plurality of rod holes, a plurality of side holes, and a plurality of set screw holes, a first rod piece that has a diameter of size configured to fit closely within to the diameter of the rod holes, a first set screw that has a diameter of size configured to fit closely within the diameter of the set screw hole, a first connection bolt that that has a diameter of size configured to fit closely within the diameter of the side hole and the plurality of members having a plurality of configurations providing structural support.

15 Claims, 9 Drawing Sheets

MODULAR RIGGING SYSTEM USING HEXAGONAL SUPPORT PIECES

CROSS-REFERENCE TO RELATED APPLICATION

This application is a continuation of U.S. patent application Ser. No. 15/842,462, entitled "MODULAR RIGGING SYSTEM USING HEXAGONAL SUPPORT PIECES," filed on Dec. 14, 2017, which in turn claims the benefit of and priority to U.S. Patent Application Ser. No. 62/434,801, filed on Dec. 15, 2016, the contents of which are incorporated by reference as if fully set forth herein.

FIELD OF THE INVENTION

The present disclosure generally relates to rigging systems using hexagonal support pieces, and, in particular, modular rigging systems that can be used to construct and support various structures. In embodiments, the hexagonal support pieces may be connected by rods and/or bolts.

BACKGROUND OF THE INVENTION

Rigging, also referred to as staging or scaffolding, is frequently used in the construction of temporary structures. Such structures can be used on buildings during construction to support workmen and equipment both on the interior and exterior of the building. Similar temporary structures are also commonly used for rigging audio and video equipment on stages and for use in art displays.

Temporary structures are most commonly erected using "tubes" and "clamps." Specifically, in such systems, vertical tubes are connected to horizontal tubes using right angle clamps.

Conventional rigging systems consist of metal pieces that can be constructed to provide support to various structures. Conventional rigging systems use right angle joints that can be oriented in limited directions.

Furthermore, conventional systems have limited options for securing the rigging system together. This further limits construction options.

However, such conventional rigging systems have many disadvantages. It is labor-intensive to construct. In addition, connections between vertical and horizontal tubes are generally limited to being made only at right angles. This limits the configurations available and the locations that this prior art rigging can be used.

Accordingly, a new type of rigging system is needed to overcome these and other problems and provide a modular, versatile and safe temporary structure.

BRIEF DESCRIPTION OF THE DRAWINGS

Exemplary embodiments of the present invention will be described with reference to the accompanying figures, wherein.

SUMMARY OF INVENTION

The present invention generally relates to an improved modular rigging system using hexagonal support pieces and rods.

In embodiments, the present invention is a rigging system comprising a plurality of members including a first hexagonal support piece comprising six side members, at least one rod hole, at least one side hole, and at least one set screw hole; a first rod piece that has a cross-section of size and shape configured to fit closely within the cross-section of the rod holes; a first set screw that has a cross-section of size and shape configured to fit closely within the cross-section of the set screw hole; a first connection bolt that that has a cross-section of size and shape configured to fit closely within the cross-section of the side hole; with the plurality of members having a plurality of configurations providing structural support.

In embodiments, the side members are joined at equiangular configurations.

In embodiments, the set screws are threaded and the set screw holes are tapped to fit a threaded bolt.

In embodiments, the connection bolts are threaded.

In embodiments, the side holes are tapped to fit a threaded bolt.

In embodiments, the rod holes are at the corners of the hexagonal support pieces.

In embodiments, there are six rod holes in a hexagonal support piece.

In embodiments, there are side holes at the midpoints of each side of the hexagonal support piece.

In embodiments, the rod pieces have a cylindrical cross-section.

In embodiments, the rod pieces have a hexagonal cross-section.

In embodiments, the rod pieces have a rectangular cross-section.

In embodiments, the rod pieces are threaded so as to fit a nut.

DETAILED DESCRIPTIONS OF THE INVENTION

The present invention generally relates to modular rigging systems comprising hexagonal support pieces. The advantage of making this invention modular is that the rigging system is easily constructed and deconstructed in various orientations using interchangeable pieces.

In embodiments, a rigging system could be used to temporarily support workmen and equipment during construction. In embodiments, a rigging system could be used to support audio and video equipment on and around stages during musical and theatrical performance. Furthermore, in embodiments, a rigging system could be used in the construction and support of sets.

The inventive modular rigging systems will now be described with reference to exemplary embodiments as illustrated in FIGS. 1A-13.

Figure 1A:
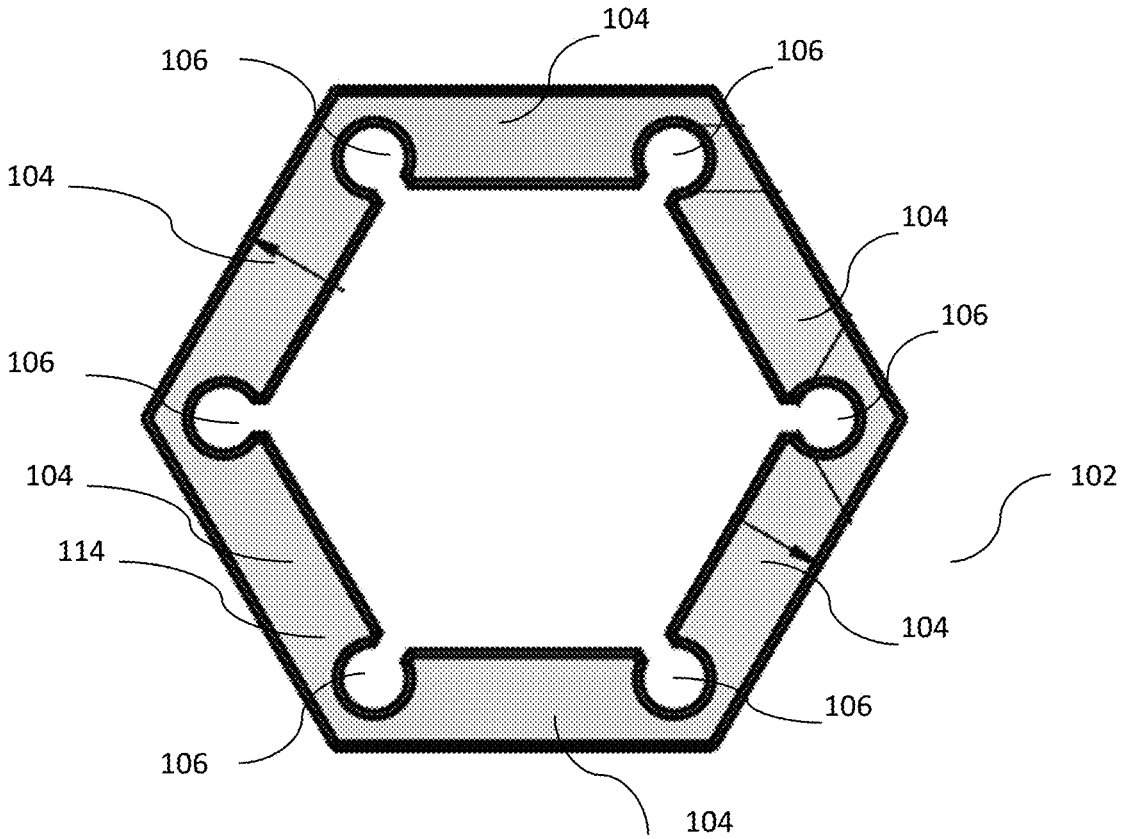
FIG. 1A shows a front view of a hexagonal support piece according to an exemplary embodiment of the invention.
Figure 1B:
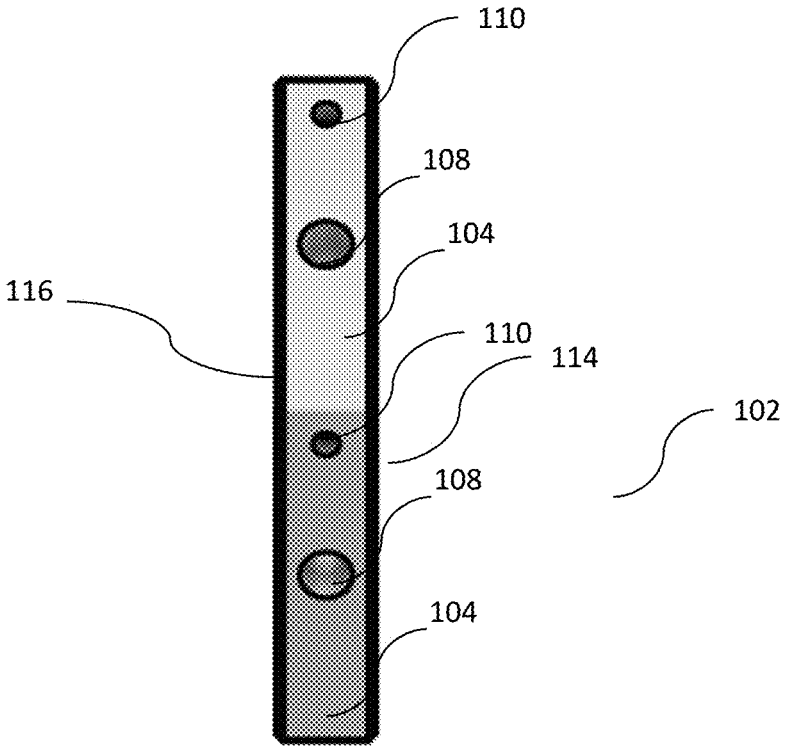
FIG. 1B shows a side view of a hexagonal support piece according to an exemplary embodiment of the invention.
Figure 1C:
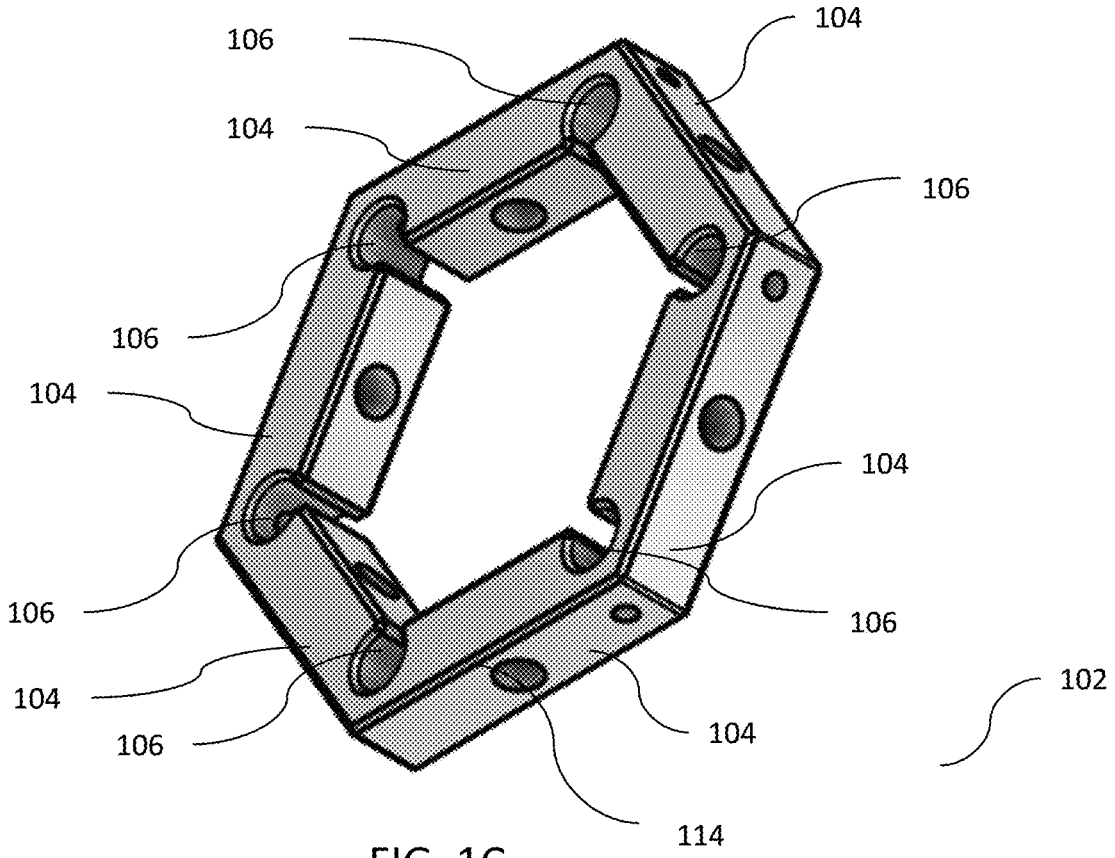
FIG. 1C shows an isometric view of a hexagonal support piece according to an exemplary embodiment of the invention.

FIGS. 1A-C show different views of a hexagonal support piece 102 in accordance with embodiments of the present invention. FIG. 1A shows a front view, FIG. 1B shows a side view, and FIG. 1C shows an isometric view of the hexagonal support piece 102.

As shown in FIGS. 1A-C, hexagonal support piece 102 has six side members 104 to form a hexagonal top and bottom surface 114 and 116. In each corner, a through hole 106 is included, which is configured to receive and hold rod pieces 202. Set screw holes 110 may be further provided for set screws to hold rod pieces in place. One or more side holes 108 are included in one or more sides. The hexagonal support piece 102, can be made in a plurality of sizes to accommodate construction in different settings.

In embodiments, the hexagonal support piece 102 can be made of supportive material, including but not limited to aluminum, steel, stainless steel, rigid plastics, iron, carbon fiber, and titanium.

In embodiments, each rod hole 106 is a substantially circular shape, so as to be configured to fit rod pieces 202. In embodiments, the rod hole 106 may be partially open or fully closed. Leaving the rod holes 106 partially open has a number of benefits. One such benefit is that it enables an alternate system of securing the rods which comprises a piece pushes and fixes the rods in place from the center of the hexagon. A second such benefit is that it provides an aesthetically pleasing ornamental design.

In embodiments, the rod holes 106 are located at the joints of the side members 104. They can also be located at a plurality of locations through the side member 104. Furthermore, there can be as few as one rod hole or a plurality of rod holes.

In embodiments, each side member 104 contains a side hole 108 situated substantially centrally and a set screw hole 110 situated such that it is both perpendicular to the side member 104 and collinear with the center for rod hole 106. In embodiments, the side hole 108 is located off center on each side member 104. In embodiments, the side hole 108 has a diameter of size configured to closely fit the connection bolt 404.

The placement of connection bolts 404, enable the hexagon support pieces 102, to be oriented or rotated in a more than one direction. This structure makes the rigging modular and adds a wide assortment of orientations and uses for the rigging system. In embodiments, the side hole 108 and the set screw hole 110 may be threaded so as to connect to a screw. The threading adds additional security in fixing the pieces together, but leaving the hole unthreaded will enable the apparatus to fit with more parts.

Figure 2A:
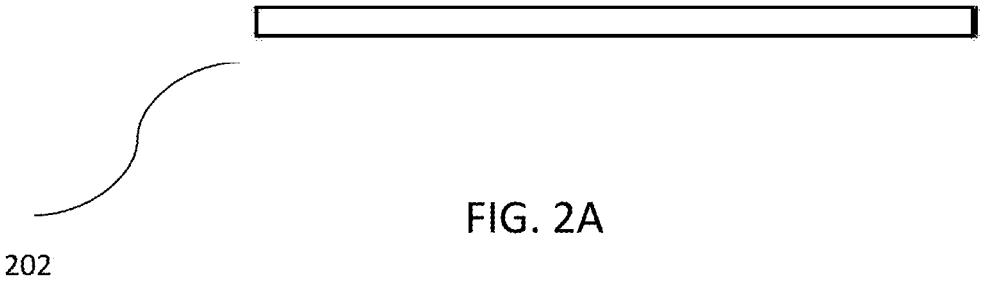
FIG. 2A. shows a front view of a rod piece 202.
Figure 2B:
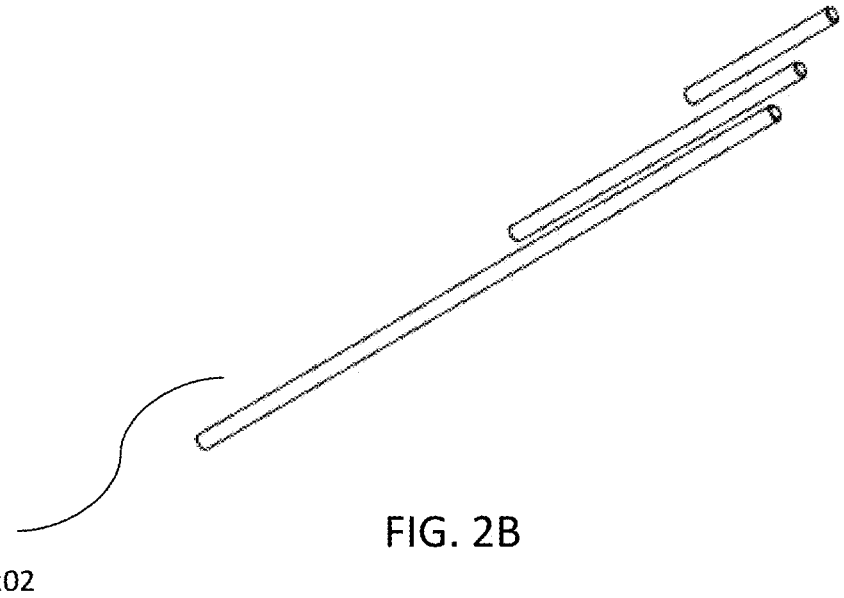
FIG. 2B. shows an isometric view of three rod pieces 202.

FIG. 2A. shows a front view of a rod piece 202. FIG. 2B. shows an isometric view of three rod pieces 202. As shown in FIGS. 2A-B, the rod pieces 202, are long cylindrical shaped pieces that fit closely into the rod holes 106 of the hexagonal support pieces 102. The rod pieces 202 are shown have a circular cross section, but can have cross sections of many shapes including but not limited to triangles, squares, and hexagons. A circular cross section enables the rigging to be oriented in infinite directions, but an angled shape aids in locking the rod pieces 202 into the hexagonal supports pieces 102. In embodiments, the rod pieces can have additional holes cut in a direction perpendicular to the length of the rod that a set screw 112 can lock into. The rod piece 202, can be made in a plurality of sizes to accommodate construction in different settings.

In embodiments, the rod piece 202 can be made of supportive materials, including but not limited to aluminum, steel, stainless steel, rigid plastics, iron, carbon fiber, and titanium.

Figure 3:
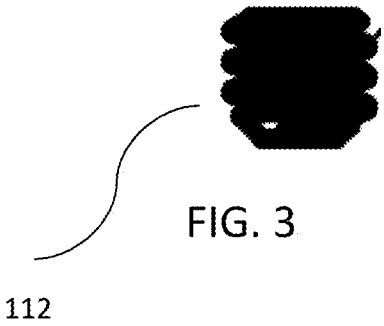
FIG. 3 shows a front view of a set screw 112.

FIG. 3 shows a front view of a set screw piece 112. The set screw piece can fit into the set screw hole 110 and secures the rod piece 202 into the rod holes 106 via friction. In embodiments, the set screw piece 112 can be made of supportive materials, including but not limited to aluminum, steel, stainless steel, rigid plastics, iron, carbon fiber, and titanium. In embodiments, the set screw piece 112 has a diameter of size configured to closely fit the diameter of the set screw hole 110 in a hexagonal support piece 102.

Figure 4:
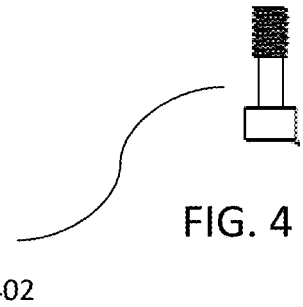
FIG. 4 shows a front view of a connection bolt 402.

FIG. 4 shows a front view of a connection bolt 402. As shown in FIG. 4, the connection bolt fits closely into the side hole 108 in the hexagonal support piece 102. The connection bolt 402 is able to secure together two hexagonal support pieces 102. In embodiments, the side holes 108 are threaded and the connection bolt 402 can screw into them. In embodiments, the connection bolt 402 extends beyond the side holes 108 and can be fixed with a nut or other object to hold a plurality of hexagonal support pieces 102 together. In embodiments, the connection bolt 402 can be made of supportive material, including but not limited to aluminum, steel, stainless steel, rigid plastics, iron, carbon fiber, and titanium. The connection bolt 402, can be made in a plurality of sizes to accommodate construction in different settings.

In embodiments, the connection bolt 402 has a diameter of size configured to fit closely in the diameter of the side hole 108 in a hexagonal support piece 102.

Figure 5A:
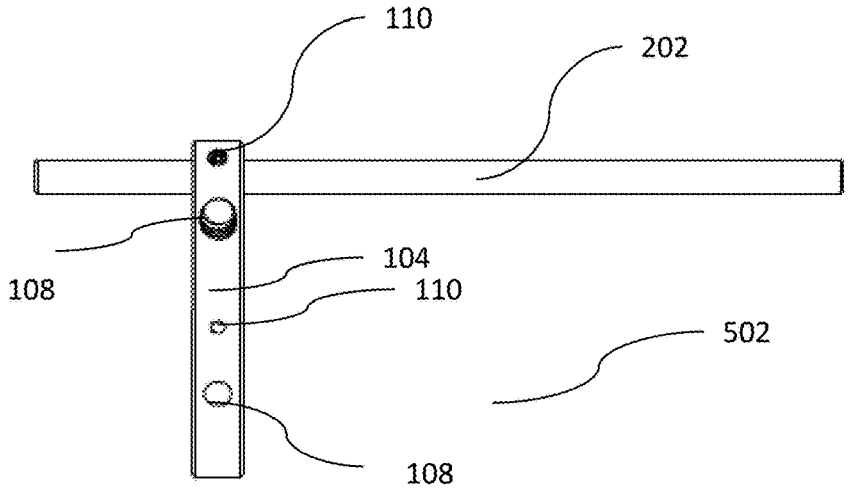
FIG. 5A shows a front view of a rigging apparatus 502.
Figure 5B:
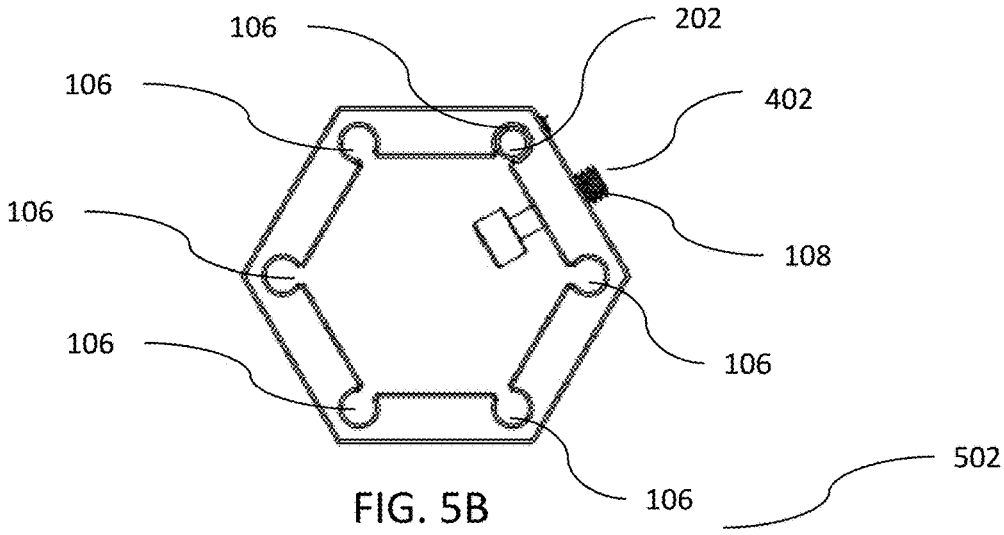
FIG. 5B shows a side view of a rigging apparatus 502.
Figure 5C:
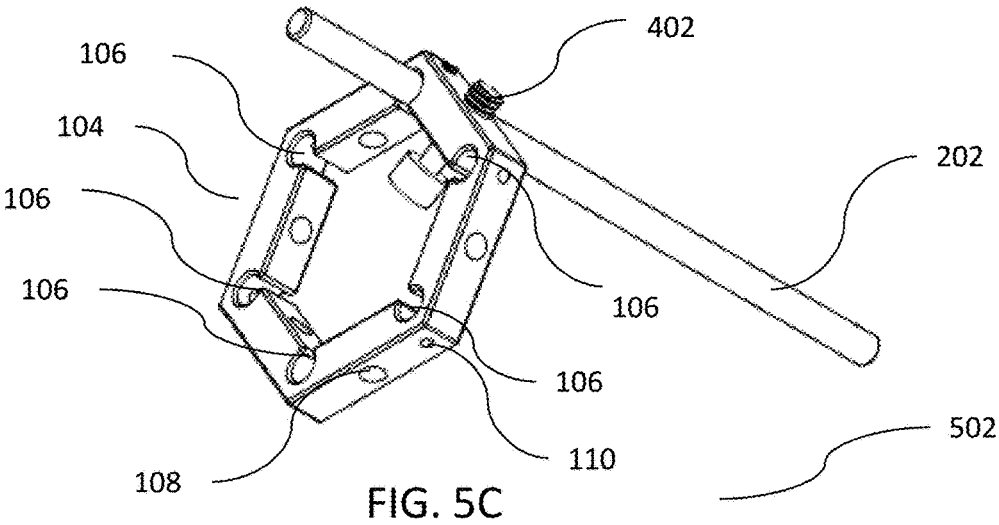
FIG. 5C shows an isometric view of a rigging apparatus 502.

FIG. 5A shows a front view of an apparatus 502, comprised of a hexagon support piece 102 and a rod 202 held in place with set screw 112. FIG. 5B shows a side view and FIG. 5C shows an isometric view of the apparatus 502. Apparatus 502 comprises a hexagonal support piece 102 with a rod piece 202 through a rod hole 106. A set screw 112 is in place in the set screw hole 110, holding the rod 202 in place. There is also a connection bolt 402 in place in the side hole 108. Apparatus 502 shows one piece of a larger configuration of the invention that can be used as a supporting structure.

Figure 6A:
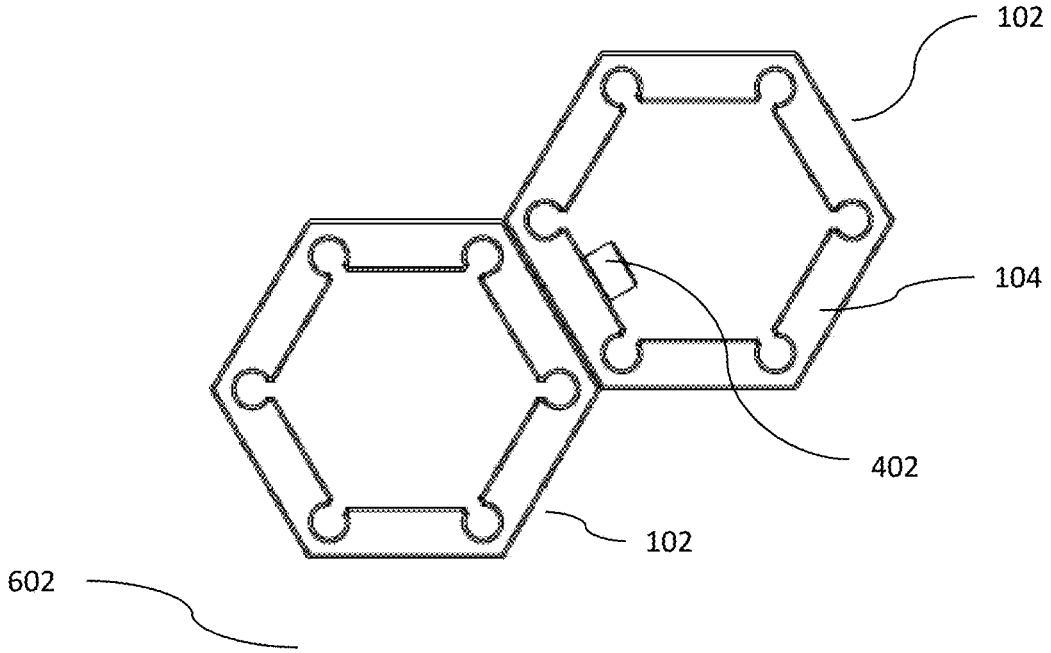
FIG. 6A shows a front view of a rigging apparatus 602.
Figure 6B:
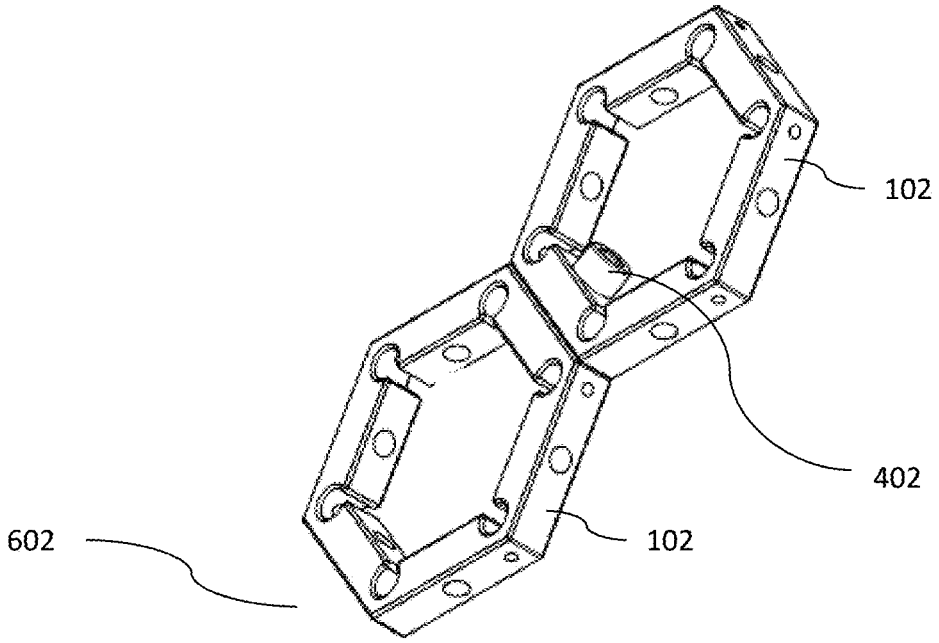
FIG. 6B shows an isometric view of a rigging apparatus 602.

FIG. 6A shows a front view of an apparatus 602. FIG. 6B shows an isometric view of an apparatus 602. The apparatus 602 comprises two hexagonal support pieces 102 connected with a connection bolt 402 in place in the side holes 108 of both hexagonal support pieces 102. This combination of a plurality of hexagonal support pieces 102 can be called a cluster. Clusters of hexagonal support pieces 102 comprise a plurality of hexagonal support pieces 102 connected while in contact. They can be oriented in a plurality of directions. The hexagonal support pieces 102, in apparatus 602, can each be turned in a full circumference, enabling the rigging to be oriented in an infinite number of directions. This adds to the possibilities of configurations and to the modular nature of the invention.

Figure 7:
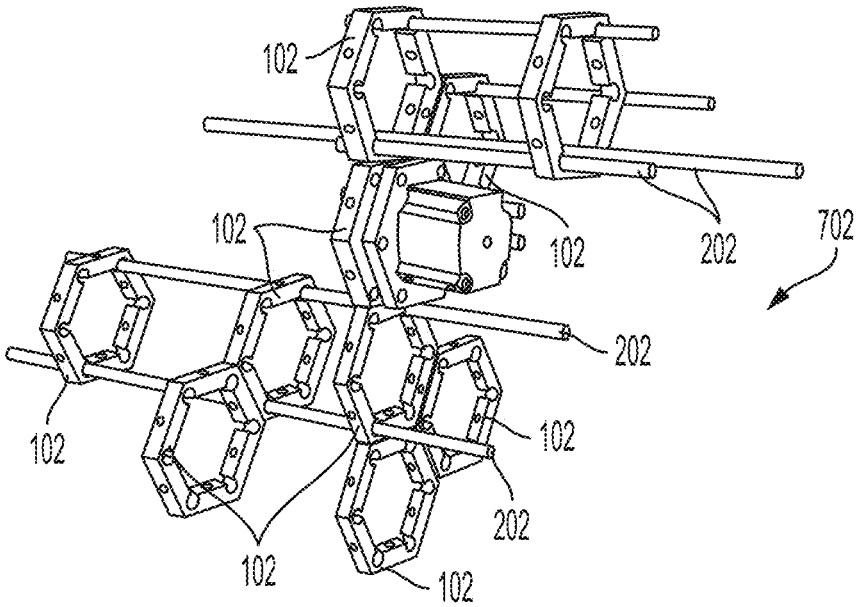
FIG. 7 shows an isometric view of a rigging apparatus 702.

FIG. 7 shows an isometric view of apparatus 702 of 10 hexagonal support pieces 102, connected by 6 rod pieces 202. This is one of a plurality of orientations and constructions that can be created using the invention. Apparatus 702 demonstrates the versatility of the invention in that in embodiments, clusters can be formed of a different number of hexagonal support pieces 102 in the same use and also that hexagonal support pieces 102 can stand alone without a cluster. The connection bolts 402 are not shown in this figure.

Figure 8:
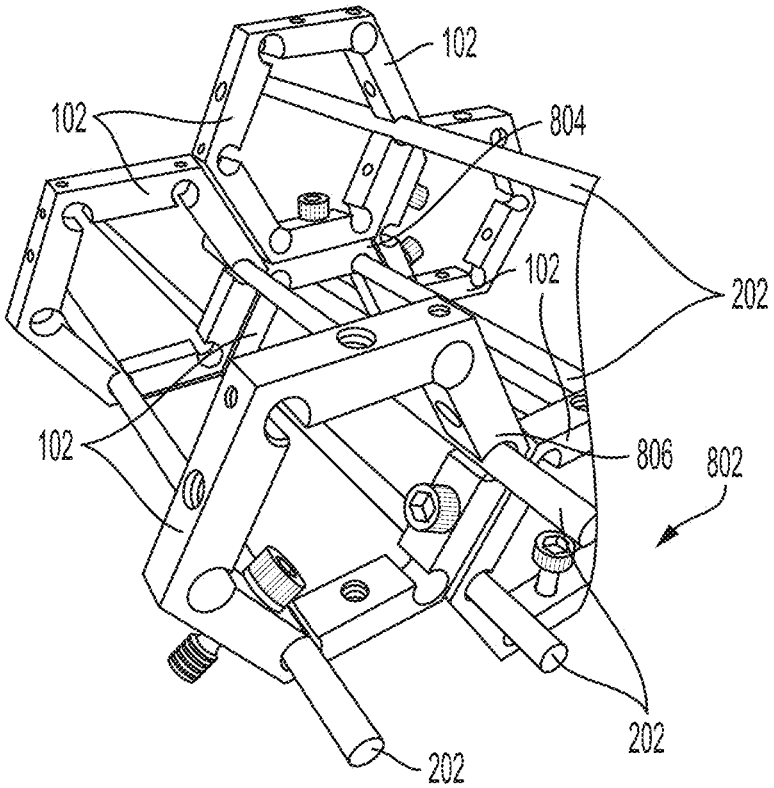
FIG. 8 shows an isometric view of a rigging apparatus 802.

FIG. 8 shows an isometric view of apparatus 802 of 5 hexagonal support pieces 102, connected by 5 rod pieces 202 and 5 connection pieces 402. This is one of a plurality of orientations and constructions that can be created using the invention. Apparatus 802 demonstrates the versatility of the invention in that it provides many configurations. Cluster 804 shows that in embodiments, four hexagonal support pieces 102 can be joined to form a cluster, whereas cluster 806 shows in embodiments, only two hexagonal support pieces need be joined to form a cluster. This variety enables the invention to be used in many different settings to support many different objects or people.

Figure 9:
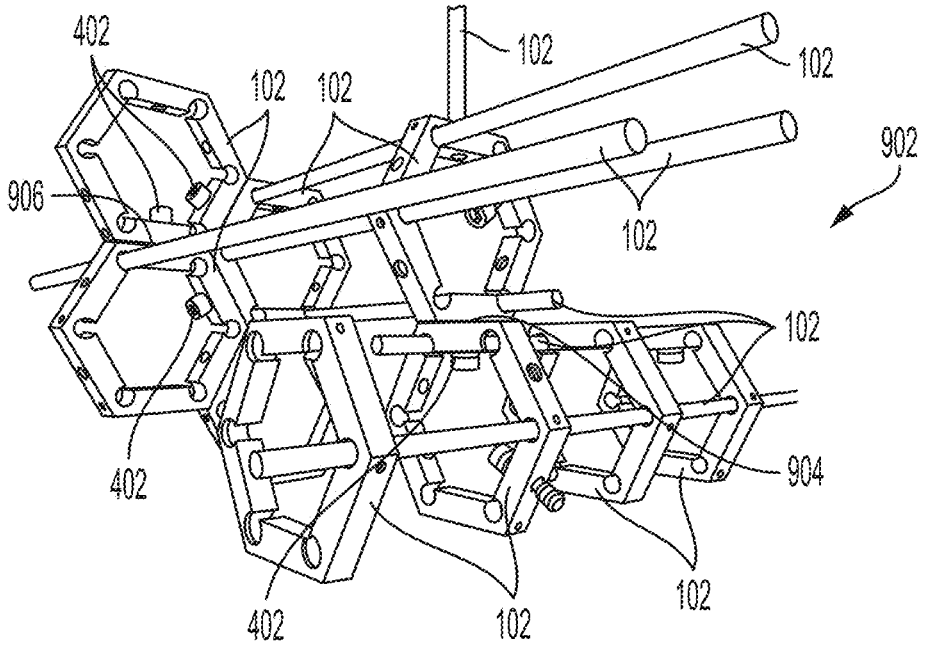
FIG. 9 shows an isometric view of a rigging apparatus 902.

FIG. 9 shows an isometric view of apparatus 902 of 8 hexagonal support pieces 102, connected by 5 rod pieces 202 and 3 connection pieces 402. Connections 904 and 906 exemplify two different angles the hexagonal support pieces 102 can be connected at. This variety of available angles enables the invention to be oriented in a plurality of directions and enables it to be used in more locations.

Figure 10:
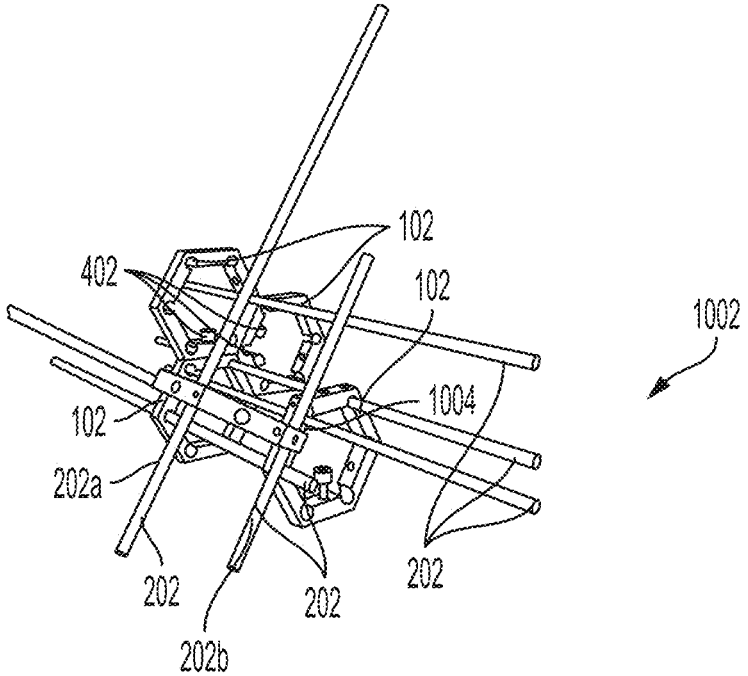
FIG. 10 shows an isometric view of a rigging apparatus 1002.

FIG. 10 shows an isometric view of apparatus 1002 of 4 hexagonal support pieces 102, connected by 5 rod pieces 202 and 3 connection pieces 402. Connection 1004 between two hexagonal support pieces 102 exemplifies an angle at which the hexagonal support pieces can be oriented. Furthermore, the angles of rods 202*a* and 202*b* with the ground exemplify that the this rigging system is not limited to orthogonal angles, which increases the possible uses and orientations it may have.

Figure 11:
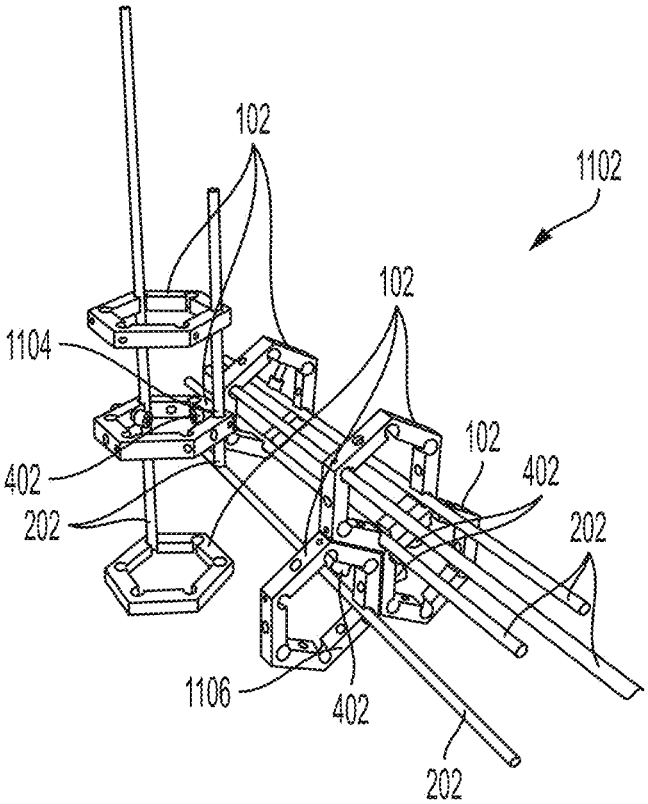
FIG. 11 shows an isometric view of a rigging apparatus 1102.

FIG. 11 shows an isometric view of apparatus 1102 of 7 hexagonal support pieces 102, connected by 6 rod pieces 202 and 4 connection pieces 402. Connections 1104 and 1106 exemplify two different angles the hexagonal support pieces 102 can be connected at. Furthermore, being able to orient the hexagonal support pieces 102 in this variety of directions enables the rod pieces 202 to also be oriented in a plurality of directions. Apparatus 1102 exemplifies the rods pieces 202 being oriented in both vertical and horizontal directions. This variety of available angles enables the invention to be oriented in a plurality of directions and enables it to be used in more locations. Cluster 1106 shows that in embodiments, three hexagonal support pieces 102 can be joined to form a cluster. This variety enables the invention to be used in many different settings to support many different objects or people.

Figure 12:
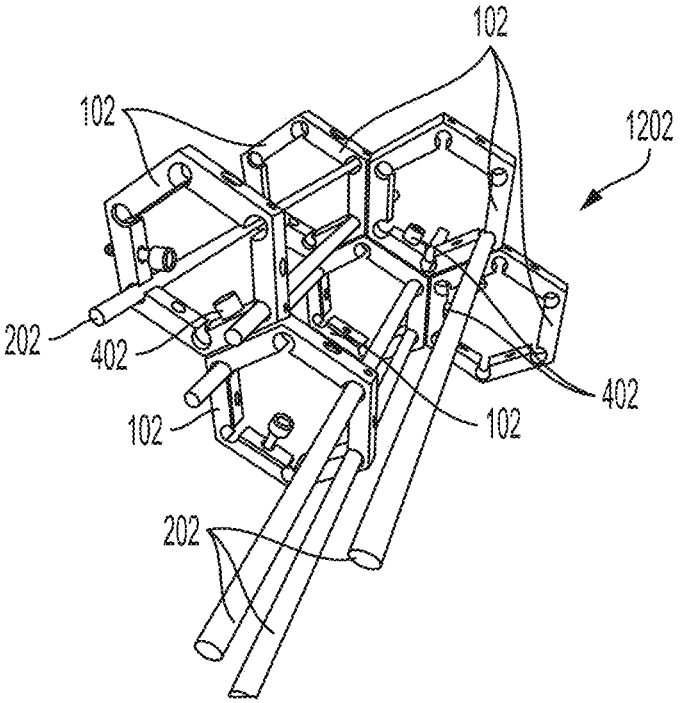
FIG. 12 shows an isometric view of a rigging apparatus 1202.

FIG. 12 shows an isometric view of apparatus 1202 of 6 hexagonal support pieces 102, connected by 7 rod pieces 202 and 4 connection pieces 402. This is one of a plurality of orientations and constructions that can be created using the invention. Apparatus 1202 demonstrates the versatility of the invention in that in embodiments, clusters can be formed of a different number of hexagonal support pieces 102 in the same use.

Figure 13:
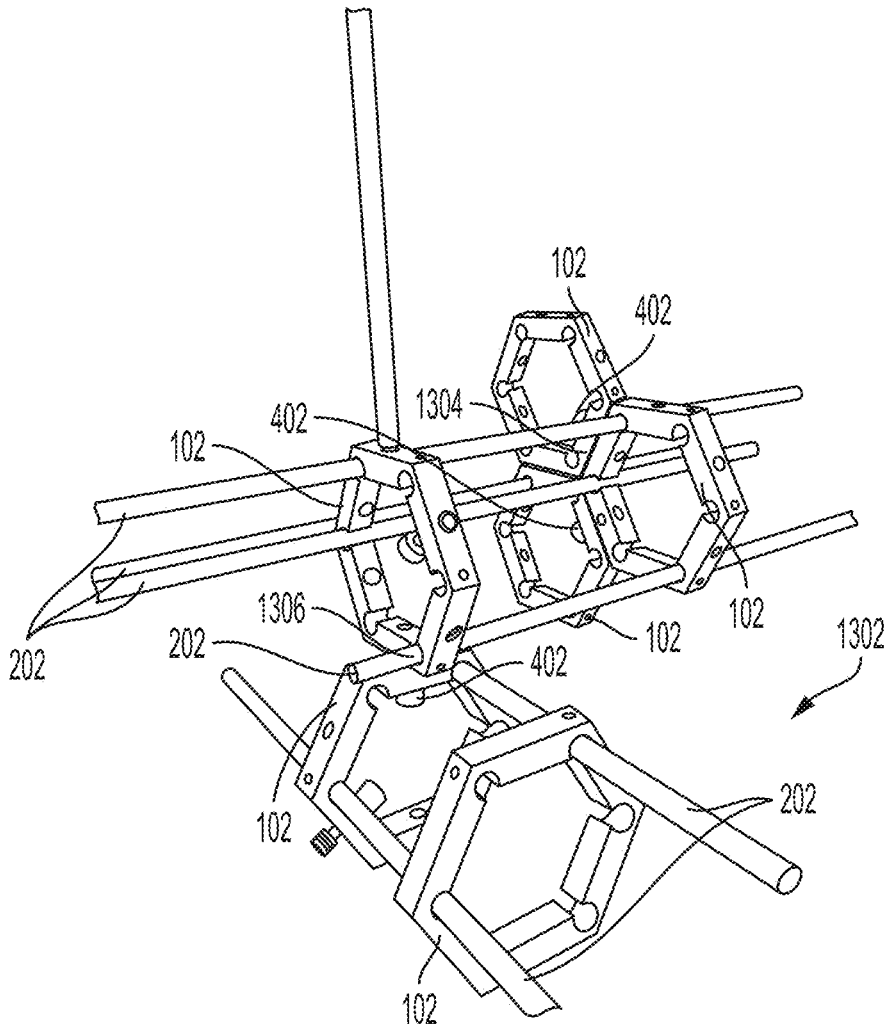
FIG. 13 shows an isometric view of a rigging apparatus 1302.

FIG. 13 shows an isometric view of apparatus 1202 of 6 hexagonal support pieces 102, connected by 6 rod pieces 202 and 4 connection pieces 402. Connections 1304 and 1306 exemplify two different angles the hexagonal support pieces 102 can be connected at. Furthermore, being able to orient the hexagonal support pieces 102 in this variety of directions enables the rod pieces 202 to also be oriented in a plurality of directions. Apparatus 1302 exemplifies the rods pieces 202 being oriented in both vertical and horizontal directions. This variety of available angles enables the invention to be oriented in a plurality of directions and enables it to be used in more locations.

FIGS. 5-13 show just some examples of how embodiments of the present invention can be configured. This wide variety of options exemplify part of the utility of this invention in that these structures can be built to fit in many locations and support many types of structures. Other configurations not shown may be compiled in accordance with embodiments of the present invention.

The inventors have found that this invention has resulted in unexpected advantages. The ease with which the pieces can be connected and disconnected makes for easy building. Furthermore, the shapes of the pieces enable many configurations which allows the user to support many different types of objects in many different space constraints. Further, the shapes of the pieces provide for significant supportive strength.

Now that embodiments of the present invention have been shown and described in detail, various modifications and improvements thereon will become readily apparent to those skilled in the art. Accordingly, the spirit and scope of the present invention is to be construed broadly and not limited by the foregoing specification.

What is claimed is:

1. A rigging system comprising:

(a) a first hexagonal support piece comprising:

(1) six first side members arranged to provide a first hexagonal top surface and a first hexagonal bottom surface;

(2) six first rod holes extending from the first hexagonal top surface to the first hexagonal bottom surface, wherein an inner wall adjacent to each of the six first rod holes is at least partially open with a gap between and separating two first side members and forming a passage into each respective rod holes;

(3) six first side holes, each first side hole extending from an outer side to an inner side of a respective side member of the six first side members; and (4) six first set screw holes, each set screw hole extending from the outer side of the respective side member to intersect a different respective rod hole of the six first rod holes;

(b) a second hexagonal support piece comprising:

(1) six second side members arranged to provide a second hexagonal top surface and a second hexagonal bottom surface;

(2) six second rod holes extending from the second hexagonal top surface to the second hexagonal bottom surface, wherein an inner wall adjacent to each of the six second rod holes is at least partially open with a gap between and separating two side members and forming a passage into each respective rod holes;

(3) six second side holes, each second side hole extending from an outer side to an inner side of a second respective side member of the six second side members; and (4) six second set screw holes, each second set screw hole extending from the outer side of the second respective side member to intersect a different second respective rod hole of the six second rod holes; and (c) at least one connection bolt that has a cross-section of size and shape configured to fit closely within a cross-section of at least one side hole of the six first side holes of the first hexagonal support piece and a cross-section of at least one second side hole of the six second side holes of the second hexagonal support piece and extends outward therefrom, wherein the at least one connection bolt connects a first respective side member of the six first side members of the first hexagonal support piece to a second respective side member of the six second side members of the second hexagonal support piece such that the second hexagonal support piece is rotated with respect to the first hexagonal support piece.

2. The system of claim 1 wherein the six first side members of the first hexagonal support piece and the six second side members of the second hexagonal support piece are joined to each other at six equiangular corners.

3. The system of claim 1 wherein the at least one connection bolt is threaded and at least one side hole of the six first side holes or the six second side holes is tapped to receive the at least one threaded connection bolt.

4. The system of claim 1, wherein the at least one connection bolt is threaded, wherein the six first side holes are formed to receive the at least one threaded connection bolt, and wherein the six second side holes are formed to receive the at least one threaded connection bolt.

5. The system of claim 1, wherein each side hole of the six first side holes is positioned at a respective midpoint of each exterior side of the first hexagonal support piece.

6. The system of claim 1 wherein each side hole of the six second side holes is positioned at a respective midpoint of each exterior side of the second hexagonal support piece.

7. The system of claim 1, wherein the second hexagonal support piece is rotated ninety degrees with respect to the first hexagonal support piece and a third hexagonal support piece.

8. The system of claim 1, wherein each rod hole of the six first rod holes is positioned at a respective corner of the first hexagonal support piece.

9. The system of claim 1, wherein each rod hole of the six second rod holes is positioned at a respective corner of the second hexagonal support piece.

10. The system of claim 1, further comprising:

(d) a third hexagonal support piece comprising;

(1) six third side members arranged to provide a third hexagonal top surface and a third hexagonal bottom surface, (2) six third rod holes extending from the third hexagonal top surface to the third hexagonal bottom surface, (3) six third side holes, each third side hole extending from an outer side to an inner side of a third respective side member of the six third side members; and (4) six third set screw holes, each third set screw hole extending from the outer side of the third respective side member to intersect a different third respective rod hole; and (e) at least one rod;

wherein a first end of the at least one rod is received in a first respective rod hole of the six second rod holes of the second hexagonal support piece and a second end of the at least one rod is received in a second respective rod hole of the six third rod holes of the third hexagonal support piece.

11. The system of claim 10, wherein the second hexagonal support piece and the third hexagonal support piece are positioned below the first hexagonal support piece.

12. The system of claim 10, further comprising:

(e) a first set screw received in a first set screw hole intersecting the first respective rod hole; and a second set screw received in a second set screw hole intersecting the second respective rod hole.

13. The system of claim 10, wherein the at least one rod has a cylindrical cross-section.

14. The system of claim 10, wherein the at least one rod has a hexagonal cross-section.

15. The system of claim 10, wherein the at least one rod has a rectangular cross-section.

* * * * *